US010919309B2

(12) United States Patent
Tsujino

(10) Patent No.: US 10,919,309 B2
(45) Date of Patent: Feb. 16, 2021

(54) INKJET PRINTING APPARATUS WITH INK CIRCULATOR

(71) Applicant: RISO KAGAKU CORPORATION, Tokyo (JP)

(72) Inventor: Naoto Tsujino, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/571,566

(22) Filed: Sep. 16, 2019

(65) Prior Publication Data

US 2020/0101755 A1 Apr. 2, 2020

(30) Foreign Application Priority Data

Sep. 27, 2018 (JP) ..... JP2018-182293

(51) Int. Cl.
*B41J 2/18* (2006.01)

(52) U.S. Cl.
CPC ..... *B41J 2/18* (2013.01)

(58) Field of Classification Search
CPC ..... B41J 2/18
See application file for complete search history.

(56) References Cited

U.S. PATENT DOCUMENTS

| | | | | |
|---|---|---|---|---|
| 10,328,704 | B2 | 6/2019 | Katada et al. | |
| 2016/0339713 | A1* | 11/2016 | Nishiyama | B41J 2/175 |
| 2018/0134033 | A1 | 5/2018 | Sawase | |
| 2018/0147854 | A1* | 5/2018 | Yoshida | B41J 2/17596 |
| 2020/0230971 | A1* | 7/2020 | Nishizawa | B41J 2/17596 |

FOREIGN PATENT DOCUMENTS

| | | |
|---|---|---|
| EP | 3369578 | 9/2018 |
| JP | 2016-215626 | 12/2016 |

OTHER PUBLICATIONS

The extended European Search Report, European Patent Office, Application No. 19199880.6, dated Feb. 28, 2020 (in English).

* cited by examiner

*Primary Examiner* — Scott A Richmond
(74) *Attorney, Agent, or Firm* — Greenblum & Bernstein, P.L.C.

(57) ABSTRACT

An ink circulator includes a first tank configured to supply ink to an inkjet head, a second tank configured to collect the ink from the inkjet head, an inter-tank path through which the ink is delivered from the second tank to the first tank, and an ink deliverer arranged in the inter-tank path and configured to deliver the ink from the second tank to the first tank through the inter-tank path. A third tank and the inter-tank path are connected via a connection path in which a switch arranged. Ink supply to the ink circulator is performed by driving the ink deliverer to deliver the ink from the third tank to the first tank with communication between the inter-tank path and the third tank allowed by the switch.

4 Claims, 8 Drawing Sheets

FIG. 5A

| CONDITION | INK SUPPLY VALVE | INK CIRCULATION PUMP |
|---|---|---|
| POSITIVE PRESSURIZATION TANK LIQUID LEVEL SENSOR: OFF<br>NEGATIVE PRESSURIZATION TANK LIQUID LEVEL SENSOR, FIRST NEGATIVE PRESSURIZATION TANK THRESHOLD: OFF<br>NEGATIVE PRESSURIZATION TANK LIQUID LEVEL SENSOR, SECOND NEGATIVE PRESSURIZATION TANK THRESHOLD: OFF | OPEN | OFF |
| POSITIVE PRESSURIZATION TANK LIQUID LEVEL SENSOR: OFF<br>NEGATIVE PRESSURIZATION TANK LIQUID LEVEL SENSOR, FIRST NEGATIVE PRESSURIZATION TANK THRESHOLD: OFF<br>NEGATIVE PRESSURIZATION TANK LIQUID LEVEL SENSOR, SECOND NEGATIVE PRESSURIZATION TANK THRESHOLD: ON | OPEN | ON |
| POSITIVE PRESSURIZATION TANK LIQUID LEVEL SENSOR: OFF<br>NEGATIVE PRESSURIZATION TANK LIQUID LEVEL SENSOR, FIRST NEGATIVE PRESSURIZATION TANK THRESHOLD: ON<br>NEGATIVE PRESSURIZATION TANK LIQUID LEVEL SENSOR, SECOND NEGATIVE PRESSURIZATION TANK THRESHOLD: ON | CLOSED | ON |
| POSITIVE PRESSURIZATION TANK LIQUID LEVEL SENSOR: ON<br>NEGATIVE PRESSURIZATION TANK LIQUID LEVEL SENSOR, FIRST NEGATIVE PRESSURIZATION TANK THRESHOLD: OFF<br>NEGATIVE PRESSURIZATION TANK LIQUID LEVEL SENSOR, SECOND NEGATIVE PRESSURIZATION TANK THRESHOLD: OFF | CLOSED | OFF |
| POSITIVE PRESSURIZATION TANK LIQUID LEVEL SENSOR: ON<br>NEGATIVE PRESSURIZATION TANK LIQUID LEVEL SENSOR, FIRST NEGATIVE PRESSURIZATION TANK THRESHOLD: OFF<br>NEGATIVE PRESSURIZATION TANK LIQUID LEVEL SENSOR, SECOND NEGATIVE PRESSURIZATION TANK THRESHOLD: ON | CLOSED | OFF |
| POSITIVE PRESSURIZATION TANK LIQUID LEVEL SENSOR: ON<br>NEGATIVE PRESSURIZATION TANK LIQUID LEVEL SENSOR, FIRST NEGATIVE PRESSURIZATION TANK THRESHOLD: ON<br>NEGATIVE PRESSURIZATION TANK LIQUID LEVEL SENSOR, SECOND NEGATIVE PRESSURIZATION TANK THRESHOLD: ON | CLOSED | OFF |

FIG. 5B

| CONDITION | INK CARTRIDGE PUMP |
|---|---|
| SUB-TANK LIQUID LEVEL SENSOR: OFF | ON |
| SUB-TANK LIQUID LEVEL SENSOR: ON | OFF |

FIG. 6A

| CONDITION | POSITIVE PRESSURIZATION AIR PUMP | POSITIVE PRESSURIZATION PRESSURE REGULATION VALVE |
|---|---|---|
| $Pk < Pks$ | ON | CLOSED |
| $Pk \geqq Pks$ | OFF | OPEN |

FIG. 6B

| CONDITION | NEGATIVE PRESSURIZATION AIR PUMP | NEGATIVE PRESSURIZATION PRESSURE REGULATION VALVE |
|---|---|---|
| $\lvert Pf \rvert < \lvert Pfs \rvert$ | ON | CLOSED |
| $\lvert Pf \rvert \geqq \lvert Pfs \rvert$ | OFF | OPEN |

INKJET PRINTING APPARATUS WITH INK CIRCULATOR

CROSS REFERENCE TO RELATED APPLICATION

This application is based upon and claims the benefit of priority from the prior Japanese Patent Application No. 2018-182293, filed on Sep. 27, 2018, the entire contents of which are incorporated herein by reference.

BACKGROUND

1. Technical Field

The disclosure relates to an ink circulation type inkjet printing apparatus.

2. Related Art

There is known an inkjet printing apparatus including an ink circulator having a tank which is arranged upstream of an inkjet head, a tank which is arranged downstream of the inkjet head, and an ink circulation pump which delivers the ink from the downstream tank to the upstream tank.

In this printing apparatus, printing is performed by supplying the ink from the upstream tank to the inkjet head and ejecting the ink from the inkjet head. The ink not consumed in the inkjet head is collected and stored in the downstream tank. The ink in the downstream tank is sent to the upstream tank by the ink circulation pump and is supplied from the upstream tank to the inkjet head to be used for the printing. The ink circulation and the printing are performed as described above.

When the ink is ejected from the inkjet head and the amount of the ink in the ink circulator decreases, the ink is supplied to the ink circulator. In this regard, Japanese Patent Application Publication No. 2016-215626 describes a technique using a sub-tank connected to an ink path from the downstream tank serving as a negative pressurization tank to the upstream tank serving as a positive pressurization tank. Specifically, the ink is drawn from the sub-tank to the negative pressurization tank with a negative pressure generated therein to supply the ink to the ink circulator.

SUMMARY

In the technique of Japanese Patent Application Publication No. 2016-215626, in some cases, the ink supply rate decreases due to the flow path resistance of a path between the sub-tank and the negative pressurization tank and insufficient ink supply to the ink circulator occurs. Particularly in a large inkjet printing apparatus, the path between the sub-tank and the negative pressurization tank is long and the flow path resistance of this path is high. Thus, the insufficient ink supply to the ink circulator as described above may occur.

The occurrence of the insufficient ink supply can be suppressed by increasing the negative pressure generated in the negative pressurization tank to increase the ink supply rate. However, increasing the negative pressure in the negative pressurization tank requires use of a pump with a large capacity as the ink circulation pump for the ink circulation. This leads to an increase in the apparatus size.

Alternatively, there is a method of suppressing the occurrence of insufficient ink supply by increasing the ink supply rate by providing a pump dedicated to ink supply and causing the dedicated pump to supply the ink to the ink circulator. However, providing the dedicated pump also leads to an increase in the apparatus size.

The disclosure is directed to an inkjet printing apparatus which can suppress occurrence of insufficient ink supply to an ink circulator while suppressing an increase in the apparatus size.

An inkjet printing apparatus in accordance with some embodiments includes: an inkjet head; an ink circulator including a first tank configured to supply ink to the inkjet head, a second tank configured to collect the ink from the inkjet head, an inter-tank path through which the ink is delivered from the second tank to the first tank, and an ink deliverer arranged in the inter-tank path and configured to deliver the ink from the second tank to the first tank through the inter-tank path; a third tank; a connection path connecting the third tank and the inter-tank path to each other; and a switch arranged in the connection path and configured to switch whether to allow or shut off communication between the inter-tank path and the third tank. Ink supply to the ink circulator is performed by driving the ink deliverer to deliver the ink from the third tank to the first tank with the communication between the inter-tank path and the third tank allowed by the switch.

According to the aforementioned configuration, it is possible to suppress occurrence of insufficient ink supply to an ink circulator while suppressing an increase in the apparatus size.

BRIEF DESCRIPTION OF DRAWINGS

FIG. 5A is an explanatory diagram of liquid level maintaining control.

FIG. 5B is an explanatory diagram of the liquid level maintaining control.

FIG. 6A is an explanatory diagram of pressure control.

FIG. 6B is an explanatory diagram of the pressure control.

DETAILED DESCRIPTION

Figure 1:
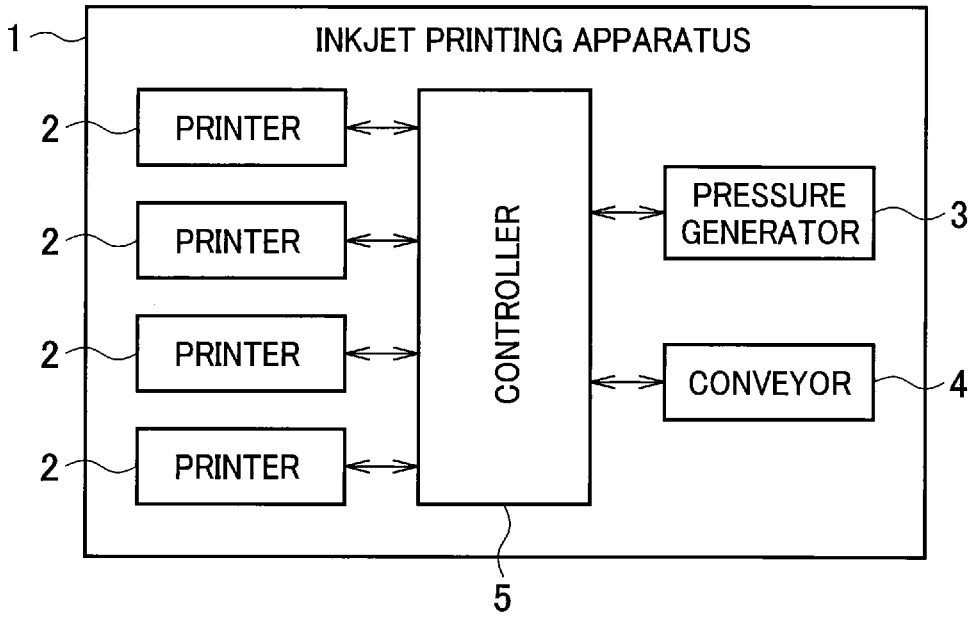
FIG. 1 is a block diagram illustrating a configuration of an inkjet printing apparatus according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings.

It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
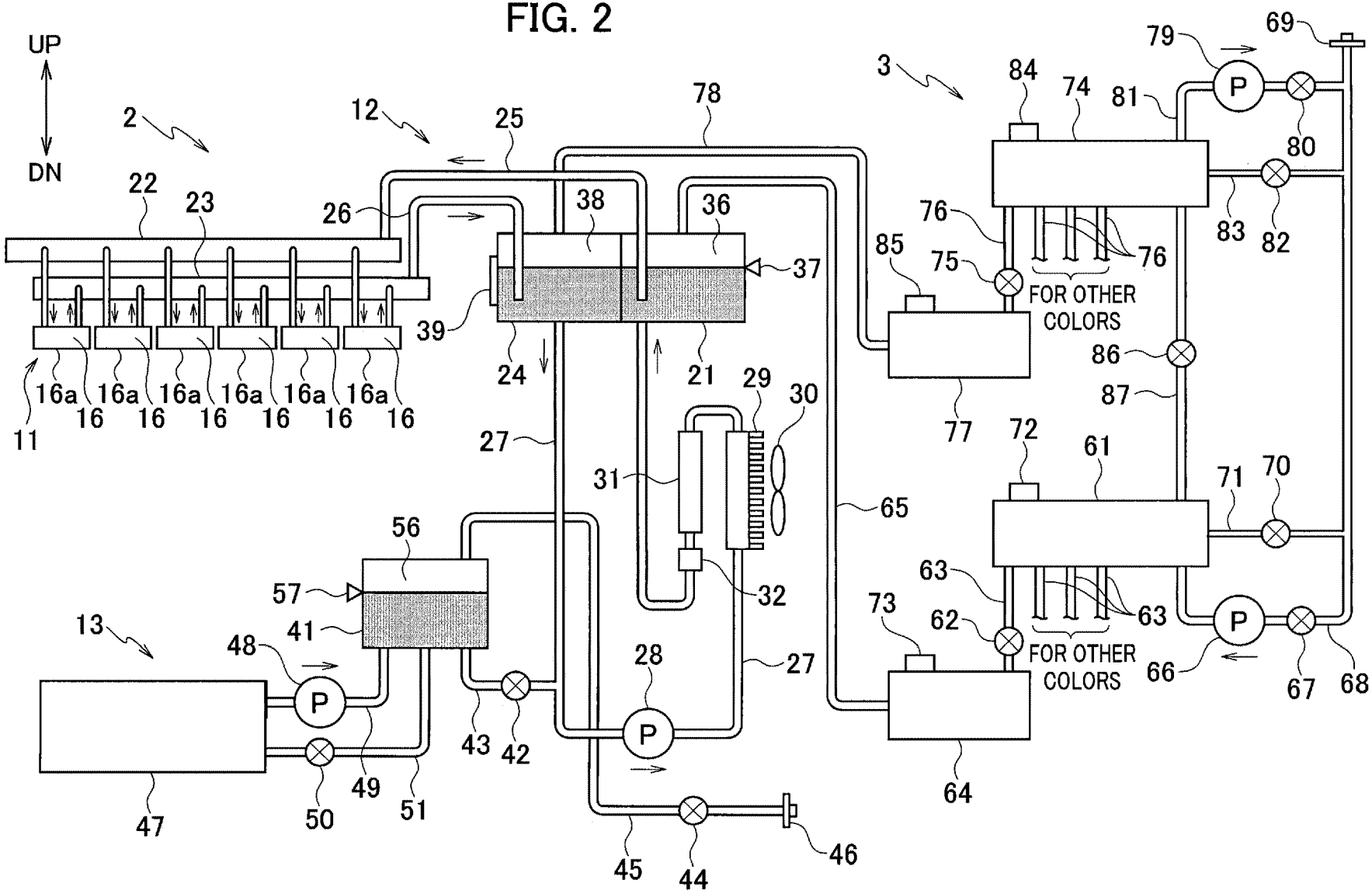
FIG. 2 is a schematic configuration diagram of a printer and a pressure generator in the inkjet printing apparatus illustrated in FIG. 1.

FIG. 1 is a block diagram illustrating a configuration of an inkjet printing apparatus 1 according to an embodiment. FIG. 2 is a schematic configuration diagram of a printer 2 and a pressure generator 3 in the inkjet printing apparatus 1 illustrated in FIG. 1. Note that an up-down direction in the following description is the vertical direction. Up and down in the sheet surface of FIG. 2 are referred to as directions of up and down and the directions of up and down are denoted by UP and DN, respectively.

As illustrated in FIG. 1, the inkjet printing apparatus 1 according to the embodiment includes four printers 2, a pressure generator 3, a conveyor 4, and a controller 5.

The printers 2 print images by ejecting inks to a sheet conveyed by the conveyor 4 while circulating the inks. The four printers 2 eject inks of different colors (for example, black, cyan, magenta, and yellow), respectively. The four printers 2 have the same configuration except for the point that the colors of the inks ejected therefrom are different. Note that the four printers 2 are assumed to be used for printing on one side of the sheet.

As illustrated in FIG. 2, each printer 2 includes an inkjet head 11, an ink circulator 12, and an ink supplier 13. Note that the configuration of the printer 2 illustrated in FIG. 2 is a configuration for one color and, as described above, the four printers 2 have the same configuration.

The inkjet head 11 ejects the ink supplied by the ink circulator 12. The inkjet head 11 includes multiple head modules 16.

Each head module 16 includes an ink chamber (not illustrated) configured to store the ink, multiple nozzles (not illustrated) configured to eject the ink, and a nozzle surface 16*a* in which the nozzles are opened. Piezoelectric elements (not illustrated) are arranged in the ink chamber. The ink is ejected from the nozzles by driving the piezoelectric elements. The nozzle surface 16*a* is a lower surface of the head module 16 facing the sheet conveyed by the conveyor 4.

The ink circulator 12 supplies the ink to the inkjet head 11 while circulating the ink. The ink circulator 12 includes a positive pressurization tank (first tank) 21, a distributor 22, a collector 23, a negative pressurization tank (second tank) 24, ink circulation pipes 25 to 27, an ink circulation pump (ink deliverer) 28, a heat sink 29, an ink cooling fan 30, a heater 31, and an ink filter 32.

The positive pressurization tank 21 supplies the ink to the inkjet head 11 by using a positive pressure applied by the pressure generator 3. The ink in the positive pressurization tank 21 is supplied to the inkjet head 11 via the ink circulation pipe 25 and the distributor 22. In other words, the positive pressurization tank 21 is arranged upstream of the inkjet head 11 in an ink circulation direction. An air space 36 is formed on the liquid surface of the ink in the positive pressurization tank 21. The positive pressurization tank 21 is connected to a positive pressurization communal air chamber 61 to be described later via a positive pressurization communication pipe 65, a positive pressurization air chamber 64, and a positive pressurization sealing pipe 63 to be described later. The positive pressurization tank 21 is arranged at a higher position than (above) the nozzle surfaces 16*a* in the inkjet head 11.

The positive pressurization tank 21 is provided with a positive pressurization tank liquid level sensor 37. The positive pressurization tank liquid level sensor 37 detects whether the liquid level height of the ink in the positive pressurization tank 21 has reached a predetermined positive pressurization tank threshold Hk. The positive pressurization tank threshold Hk is set as a reference value of the liquid level height of the ink in the positive pressurization tank 21 in ink circulation. The positive pressurization tank liquid level sensor 37 outputs a signal indicating "on" when the liquid level height in the positive pressurization tank 21 is the positive pressurization tank threshold Hk or higher and outputs a signal indicating "off" when the liquid level height in the positive pressurization tank 21 is lower than the positive pressurization tank threshold Hk.

The distributor 22 distributes the ink, supplied from the positive pressurization tank 21 via the ink circulation pipe 25, to the head modules 16 in the inkjet head 11.

The collector 23 collects the ink, not consumed in the inkjet head 11, from the head modules 16. The ink collected by the collector 23 flows to the negative pressurization tank 24 via the ink circulation pipe 26.

The negative pressurization tank 24 collects the ink, not consumed in the inkjet head 11, from the collector 23 by using a negative pressure applied by the pressure generator 3 and stores the ink. In other words, the negative pressurization tank 24 is arranged downstream of the inkjet head 11 in the ink circulation direction. An air space 38 is formed on a liquid surface of the ink in the negative pressurization tank 24. The negative pressurization tank 24 is connected to a negative pressurization communal air chamber 74 to be described later via a negative pressurization communication pipe 78, a negative pressurization air chamber 77, and a negative pressurization sealing pipe 76 to be described later. The negative pressurization tank 24 is arranged at the same height as the positive pressurization tank 21.

The negative pressurization tank 24 is provided with a negative pressurization tank liquid level sensor 39. The negative pressurization tank liquid level sensor 39 detects whether the liquid level height of the ink in the negative pressurization tank 24 has reached a predetermined first negative pressurization tank threshold Hf1 and whether the liquid level height has reached a predetermined second negative pressurization tank threshold Hf2. The first negative pressurization tank threshold Hf1 is set as a reference value of a liquid level height of the ink in the negative pressurization tank 24 in the ink circulation. The second negative pressurization tank threshold Hf2 is set as a threshold for determining whether the ink is to be supplied from the ink supplier 13 to the negative pressurization tank 24. The second negative pressurization tank threshold Hf2 is smaller than the first negative pressurization tank threshold Hf1.

In this description, a situation in which the negative pressurization tank liquid level sensor 39 detects that the liquid level height of the ink in the negative pressurization tank 24 is the first negative pressurization tank threshold Hf1 or higher is referred to as the first negative pressurization tank threshold Hf1 is "on." Similarly, a situation in which the negative pressurization tank liquid level sensor 39 detects that the liquid level height of the ink in the negative pressurization tank 24 is the second negative pressurization tank threshold Hf2 or higher is referred to as the second negative pressurization tank threshold Hf2 is "on."

Specifically, when the liquid level height in the negative pressurization tank 24 is the first negative pressurization tank threshold Hf1 or higher, the negative pressurization tank liquid level sensor 39 outputs a signal indicating that the first negative pressurization tank threshold Hf1 and the second negative pressurization tank threshold Hf2 are both "on." Moreover, when the liquid level height in the negative pressurization tank 24 is less than the first negative pressurization tank threshold Hf1 and is the second negative pressurization tank threshold Hf2 or higher, the negative pressurization tank liquid level sensor 39 outputs a signal indicating that the first negative pressurization tank threshold Hf1 is "off" and the second negative pressurization tank threshold Hf2 is "on." Furthermore, when the liquid level height in the negative pressurization tank 24 is lower than the second negative pressurization tank threshold Hf2, the negative pressurization tank liquid level sensor 39 outputs a signal indicating that the first negative pressurization tank threshold Hf1 and the second negative pressurization tank threshold Hf2 are both "off."

The ink circulation pipe 25 connects the positive pressurization tank 21 and the distributor 22 to each other. In the ink circulation pipe 25, the ink flows from the positive pressurization tank 21 to the distributor 22. The ink circulation pipe 26 connects the collector 23 and the negative pressurization tank 24 to each other. In the ink circulation pipe 26, the ink flows from the collector 23 to the negative pressurization tank 24. The ink circulation pipe 27 (inter-tank path) connects the positive pressurization tank 21 and the negative pressurization tank 24 to each other and forms a path for delivering the ink from the negative pressurization tank 24 to the positive pressurization tank 21. The ink circulation pipes 25 to 27, the distributor 22, and the collector 23 form a circulation path for circulating the ink among the positive pressurization tank 21, the inkjet head 11, and the negative pressurization tank 24.

The ink circulation pump 28 delivers the ink from the negative pressurization tank 24 to the positive pressurization tank 21 via the ink circulation pipe 27 in the ink circulation. Moreover, the ink circulation pump 28 delivers the ink from a sub-tank 41 to be described later to the positive pressurization tank 21 via part of the ink circulation pipe 27 and a connection pipe 43 to be described later in ink supply from the ink supplier 13 to the ink circulator 12. The ink circulation pump 28 is arranged in the middle of the ink circulation pipe 27.

The heat sink 29 dissipates heat to cool the ink circulated in the ink circulator 12. The heat sink 29 is provided in the middle of the ink circulation pipe 27.

The ink cooling fan 30 sends cooling air to the heat sink 29 to cool the ink circulated in the ink circulator 12.

The heater 31 heats the ink circulated in the ink circulator 12. The heater 31 is provided in the middle of the ink circulation pipe 27.

The ink filter 32 removes dust and the like in the ink circulated in the ink circulator 12. The ink filter 32 is provided in the middle of the ink circulation pipe 27.

The ink supplier 13 supplies the ink to the ink circulator 12. The ink supplier 13 includes the sub-tank (third tank) 41, an ink supply valve (switch) 42, a connection pipe (connection path) 43, a sub-tank atmospheric release valve 44, an atmospheric release pipe 45, an air filter 46, an ink cartridge 47, an ink cartridge pump 48, an ink delivery pipe 49, a sub-tank liquid level adjustment valve 50, and a sub-tank liquid level adjustment pipe 51.

The sub-tank 41 stores the ink to be supplied to the ink circulator 12. The sub-tank 41 receives the ink from the ink cartridge 47 and stores the supplied ink. An air space 56 is formed on the liquid surface of the ink in the sub-tank 41. The sub-tank 41 is connected to the ink circulation pipe 27 via the connection pipe 43. The sub-tank 41 is arranged at a lower position than (below) the nozzle surfaces 16*a* of the head modules 16 in the inkjet head 11.

The sub-tank 41 is provided with a sub-tank liquid level sensor 57. The sub-tank liquid level sensor 57 detects whether the liquid level height of the ink in the sub-tank 41 has reached a predetermined sub-tank threshold Hs. The sub-tank threshold Hs is set as a reference value of the liquid level height of the ink in the sub-tank 41. The sub-tank liquid level sensor 57 outputs a signal indicating "on" when the liquid level height in the sub-tank 41 is the sub-tank threshold Hs or higher and outputs a signal indicating "off" when the liquid level height is lower than the sub-tank threshold Hs.

The ink supply valve 42 opens and closes a flow path of the ink in the connection pipe 43 to switch whether to allow or shut off communication between the ink circulation pipe 27 and the sub-tank 41. The ink supply valve 42 is provided in the middle of the connection pipe 43. The ink supply valve 42 is a normally-closed solenoid valve which is open when power is supplied thereto and is closed when no power is supplied thereto.

The connection pipe 43 forms a flow path of the ink through which the ink circulation pipe 27 and the sub-tank 41 communicate with each other. One end of the connection pipe 43 is connected to a portion of the ink circulation pipe 27 between the negative pressurization tank 24 and the ink circulation pump 28 and the other end is connected to the sub-tank 41.

The sub-tank atmospheric release valve 44 opens and closes a flow path of air in the atmospheric release pipe 45 to switch the sub-tank 41 between a sealed state (state shut off from the atmosphere) and an atmospheric release state (state communicating with the atmosphere). The sub-tank atmospheric release valve 44 is provided in the middle of the atmospheric release pipe 45. The sub-tank atmospheric release valve 44 is a normally-open solenoid valve which is closed when power is supplied thereto and is open when no power is supplied thereto.

The atmospheric release pipe 45 forms a flow path of air which allows the sub-tank 41 to be open to the atmosphere. One end of the atmospheric release pipe 45 is connected to the air space 56 of the sub-tank 41 and the other end (atmospheric release end) communicates with the atmosphere via the air filter 46.

The air filter 46 prevents dust and the like in the air from entering the atmospheric release pipe 45. The air filter 46 is installed at the atmospheric release end of the atmospheric release pipe 45.

The ink cartridge 47 houses the ink to be used in the printing by the inkjet head 11. The ink cartridge 47 is arranged at a lower position than (below) the sub-tank 41.

The ink cartridge pump 48 delivers the ink from the ink cartridge 47 to the sub-tank 41 via the ink delivery pipe 49.

The ink delivery pipe 49 forms a path for delivering the ink from the ink cartridge 47 to the sub-tank 41. One end of the ink delivery pipe 49 is connected to the sub-tank 41 and the other end is connected to the ink cartridge 47.

The sub-tank liquid level adjustment valve 50 opens and closes a flow path of the ink in the sub-tank liquid level adjustment pipe 51. The sub-tank liquid level adjustment valve 50 is provided in the middle of the sub-tank liquid level adjustment pipe 51. The sub-tank liquid level adjustment valve 50 is a normally-closed solenoid valve.

The sub-tank liquid level adjustment pipe 51 forms a path for returning the ink from the sub-tank 41 to the ink cartridge 47. One end of the sub-tank liquid level adjustment pipe 51 is connected to the sub-tank 41 and the other end is connected to the ink cartridge 47.

The pressure generator 3 generates pressure for ink circulation in the positive pressurization tank 21 and the negative pressurization tank 24 of each printer 2. Specifically, the pressure generator 3 is shared by the printers 2. As illustrated in FIG. 2, the pressure generator 3 includes the positive pressurization communal air chamber 61, positive pressurization sealing valves 62, the positive pressurization sealing pipes 63, the positive pressurization air chambers 64, the positive pressurization communication pipes 65, a positive pressurization air pump 66, a positive pressurization pump upstream valve 67, an atmosphere communication pipe 68, an air filter 69, a positive pressurization pressure adjustment valve 70, a positive pressurization pressure adjustment pipe 71, a positive pressurization pressure sensor 72, abnormality detection positive pressurization pressure sensors 73, the negative pressurization communal air chamber 74, negative pressurization sealing valves 75, the negative pressurization sealing pipes 76, the negative pressurization air chambers 77, the negative pressurization communication pipes 78, a negative pressurization air pump 79, a negative pressurization pump upstream valve 80, a negative pressurization pressure generation pipe 81, a negative pressurization pressure adjustment valve 82, a negative pressurization pressure adjustment pipe 83, a negative pressurization pressure sensor 84, abnormality detection negative pressurization pressure sensors 85, a positive negative pressurization communication valve 86, and a positive negative pressurization communication pipe 87.

The positive pressurization communal air chamber 61 is an air chamber for equalizing the pressures in the positive pressurization tanks 21 of the respective printers 2. The positive pressurization communal air chamber 61 is connected to the positive pressurization tank 21 of each printer 2 via the positive pressurization sealing pipe 63, the positive pressurization air chamber 64, and the positive pressurization communication pipe 65 for the printer 2.

Each of the positive pressurization sealing valves 62 opens and closes a flow path of air in the corresponding positive pressurization sealing pipe 63 to switch whether to allow or shut off communication between the positive pressurization communal air chamber 61 and the corresponding positive pressurization air chamber 64. The positive pressurization sealing valve 62 is provided in the middle of the positive pressurization sealing pipe 63. One positive pressurization sealing valve 62 is for each printer 2. The positive pressurization sealing valve 62 is a normally-open solenoid valve. Note that FIG. 2 illustrates only the positive pressurization sealing valve 62 for one printer 2 and illustration of the other positive pressurization sealing valves 62 is omitted.

Each of the positive pressurization sealing valves 62 is closed when the printer 2 corresponding to the positive pressurization sealing valve 62 is not used for the printing. Closing the positive pressurization sealing valve 62 shuts off the communication between the positive pressurization communal air chamber 61 and the positive pressurization tank 21 of the printer 2 corresponding to the positive pressurization sealing valve 62. Accordingly, no positive pressure for ink circulation is generated for this positive pressurization tank 21.

Each of the positive pressurization sealing pipes 63 forms a flow path of air through which the positive pressurization communal air chamber 61 and the corresponding positive pressurization air chamber 64 communicate with each other. One end of the positive pressurization sealing pipe 63 is connected to the positive pressurization communal air chamber 61 and the other end is connected to the positive pressurization air chamber 64. One positive pressurization sealing pipe 63 is provided for each printer 2.

Each of the positive pressurization air chambers 64 is an air chamber provided between the positive pressurization communal air chamber 61 and the corresponding positive pressurization tank 21 to install the abnormality detection positive pressurization pressure sensor 73. One positive pressurization air chamber 64 is provided for each printer 2. Note that FIG. 2 illustrates only the positive pressurization air chamber 64 for one printer 2 and illustration of the other positive pressurization air chambers 64 is omitted.

Each of the positive pressurization air chambers 64 is connected to the positive pressurization communal air chamber 61 via the corresponding positive pressurization sealing pipe 63. Moreover, the positive pressurization air chamber 64 communicates with the air space 36 in the positive pressurization tank 21 of the printer 2 corresponding to the positive pressurization air chamber 64 via the corresponding positive pressurization communication pipe 65.

Each of the positive pressurization communication pipes 65 causes the corresponding positive pressurization air chamber and the air space 36 in the corresponding positive pressurization tank 21 to communicate with each other. One positive pressurization communication pipe 65 is provided for each printer 2. One end of the positive pressurization communication pipe 65 is connected to the positive pressurization air chamber 64 and the other end is connected to the air space 36 in the positive pressurization tank 21. Note that FIG. 2 illustrates only the positive pressurization communication pipe 65 for one printer 2 and illustration of the other positive pressurization communication pipes 65 are omitted.

The positive pressurization air pump 66 sends air to the positive pressurization communal air chamber 61 to apply the positive pressure for ink circulation to the positive pressurization tanks 21. The positive pressurization air pump 66 is arranged in the middle of the atmosphere communication pipe 68.

The positive pressurization pump upstream valve 67 opens and closes a flow path of air in the atmosphere communication pipe 68. The positive pressurization pump upstream valve 67 is arranged in the atmosphere communication pipe 68 between the positive pressurization air pump 66 and a point where the positive pressurization pressure adjustment pipe 71 is connected to the atmosphere communication pipe 68. The positive pressurization pump upstream valve 67 is a normally-closed solenoid valve.

The atmosphere communication pipe 68 forms a flow path of air through which the positive pressurization air pump 66 sends air to the positive pressurization communal air chamber 61. One end of the atmosphere communication pipe 68 is connected to the positive pressurization communal air chamber 61 and the other end (atmospheric release end) communicates with the atmosphere via the air filter 69. The positive pressurization pressure adjustment pipe 71, the negative pressurization pressure generation pipe 81, and the negative pressurization pressure adjustment pipe 83 are connected to the atmosphere communication pipe 68. The positive pressurization pressure adjustment pipe 71, the negative pressurization pressure generation pipe 81, and the negative pressurization pressure adjustment pipe 83 thereby communicate with the atmosphere.

The air filter 69 prevents dust and the like in the air from entering the atmosphere communication pipe 68. The air filter 69 is installed at the atmospheric release end of the atmosphere communication pipe 68.

The positive pressurization pressure adjustment valve 70 opens and closes a flow path of air in the positive pressurization pressure adjustment pipe 71 to adjust the pressure in the positive pressurization communal air chamber 61 and the positive pressurization tanks 21. The positive pressurization pressure adjustment valve 70 is provided in the middle of the positive pressurization pressure adjustment pipe 71. The positive pressurization pressure adjustment valve 70 is a normally-closed solenoid valve.

The positive pressurization pressure adjustment pipe 71 forms a flow path of air for adjusting the pressure in the positive pressurization communal air chamber 61 and the positive pressurization tanks 21. One end of the positive pressurization pressure adjustment pipe 71 is connected to the positive pressurization communal air chamber 61 and the other end is connected to the atmosphere communication pipe 68.

The positive pressurization pressure sensor 72 detects the pressure in the positive pressurization communal air chamber 61. The pressure in the positive pressurization communal air chamber 61 is equal to the pressure in the positive pressurization tanks 21 of the printers 2 corresponding to the open positive pressurization sealing valves 62. This is because the positive pressurization communal air chamber 61 communicates with the air spaces 36 in the positive pressurization tanks 21 of the printers 2 corresponding to the open positive pressurization sealing valves 62.

Each of the abnormality detection positive pressurization pressure sensors 73 detects the pressure in the corresponding positive pressurization air chamber 64. The pressure in the positive pressurization air chamber 64 is detected to determine whether the corresponding positive pressurization sealing valve 62 is properly closed when control of closing the positive pressurization sealing valve 62 is performed.

The negative pressurization communal air chamber 74 is an air chamber for equalizing the pressures in the negative pressurization tanks 24 of the respective printers 2. The negative pressurization communal air chamber 74 is connected to the negative pressurization tank 24 of each printer 2 via the negative pressurization sealing pipe 76, the negative pressurization air chamber 77, and the negative pressurization communication pipe 78 for the printer 2.

Each of the negative pressurization sealing valves 75 opens and closes a flow path of air in the corresponding negative pressurization sealing pipe 76 to switch whether to allow or shut off communication between the negative pressurization communal air chamber 74 and the corresponding negative pressurization air chamber 77. The negative pressurization sealing valve 75 is provided in the middle of the negative pressurization sealing pipe 76. One negative pressurization sealing valve 75 is provided for each printer 2. The negative pressurization sealing valve 75 is a normally-open solenoid valve. Note that FIG. 2 illustrates only the negative pressurization sealing valve 75 for one printer 2 and illustration of the other negative pressurization sealing valves 75 is omitted.

Each of the negative pressurization sealing valves 75 is closed when the printer 2 corresponding to the negative pressurization sealing valve 75 is not used for printing. Closing the negative pressurization sealing valve 75 shuts off the communication between the negative pressurization communal air chamber 74 and the negative pressurization tank 24 of the printer 2 corresponding to the negative pressurization sealing valve 75. Accordingly, no negative pressure for ink circulation is generated for this negative pressurization tank 24.

Each of the negative pressurization sealing pipes 76 forms a flow path of air through which the negative pressurization communal air chamber 74 and the corresponding negative pressurization air chamber 77 communicate with each other. One end of the negative pressurization sealing pipe 76 is connected to the negative pressurization communal air chamber 74 and the other end is connected to the negative pressurization air chamber 77. One negative pressurization sealing pipe 76 is provided for each printer 2.

Each of the negative pressurization air chambers 77 is an air chamber provided between the negative pressurization communal air chamber 74 and the corresponding negative pressurization tank 24 to install the abnormality detection negative pressurization pressure sensor 85. One negative pressurization air chamber 77 is provided for each printer 2. Note that FIG. 2 illustrates only the negative pressurization air chamber 77 for one printer 2 and illustration of the other negative pressurization air chambers 77 are omitted.

Each of the negative pressurization air chambers 77 is connected to the negative pressurization communal air chamber 74 via the corresponding negative pressurization sealing pipe 76. Moreover, the negative pressurization air chamber 77 communicates with the air space 38 in the negative pressurization tank 24 of the printer 2 corresponding to the negative pressurization air chamber 77 via the corresponding negative pressurization communication pipe 78.

Each of the negative pressurization communication pipes 78 causes the corresponding negative pressurization air chamber and the air space 38 in the corresponding negative pressurization tank 24 to communicate with each other. One negative pressurization communication pipe 78 is provided for each printer 2. One end of the negative pressurization communication pipe 78 is connected to the negative pressurization air chamber 77 and the other end is connected to the air space 38 in the negative pressurization tank 24. Note that FIG. 2 illustrates only the negative pressurization communication pipe 78 for one printer 2 and illustration of the other negative pressurization communication pipes 78 are omitted.

The negative pressurization air pump 79 sucks air from the negative pressurization communal air chamber 74 to apply negative pressure for ink circulation to the negative pressurization tanks 24. The negative pressurization air pump 79 is arranged in the middle of the negative pressurization pressure generation pipe 81.

The negative pressurization pump upstream valve 80 opens and closes a flow path of air in the negative pressurization pressure generation pipe 81. The negative pressurization pump upstream valve 80 is arranged in the negative pressurization pressure generation pipe 81, closer to the atmosphere communication pipe 68 than the negative pressurization air pump 79 is. The negative pressurization pump upstream valve 80 is a normally-closed solenoid valve.

The negative pressurization pressure generation pipe 81 forms a flow path of air through which the negative pressurization air pump 79 sucks air from the negative pressurization communal air chamber 74. One end of the negative pressurization pressure generation pipe 81 is connected to the negative pressurization communal air chamber 74 and the other end is connected to the atmosphere communication pipe 68.

The negative pressurization pressure adjustment valve 82 opens and closes a flow path of air in the negative pressurization pressure adjustment pipe 83 to adjust the pressure in the negative pressurization communal air chamber 74 and the negative pressurization tanks 24. The negative pressurization pressure adjustment valve 82 is provided in the middle of the negative pressurization pressure adjustment pipe 83. The negative pressurization pressure adjustment valve 82 is a normally-closed solenoid valve.

The negative pressurization pressure adjustment pipe 83 forms a flow path of air for adjusting the pressure in the negative pressurization communal air chamber 74 and the negative pressurization tanks 24. One end of the negative pressurization pressure adjustment pipe 83 is connected to the negative pressurization communal air chamber 74 and the other end is connected to the atmosphere communication pipe 68.

The negative pressurization pressure sensor 84 detects the pressure in the negative pressurization communal air chamber 74. The pressure in the negative pressurization communal air chamber 74 is equal to the pressure in the negative pressurization tanks 24 of the printers 2 corresponding to the open negative pressurization sealing valves 75. This is because the negative pressurization communal air chamber 74 communicates with the air spaces 38 in the negative pressurization tanks 24 of the printers 2 corresponding to the open negative pressurization sealing valves 75.

Each of the abnormality detection negative pressurization pressure sensors 85 detects the pressure in the corresponding negative pressurization air chamber 77. The pressure in the negative pressurization air chamber 77 is detected to determine whether the corresponding negative pressurization sealing valve 75 is properly closed when control of closing the negative pressurization sealing valve 75 is performed.

The positive negative pressurization communication valve 86 opens and closes a flow path of air in the positive negative pressurization communication pipe 87 to switch whether to allow or shut-off communication between the positive pressurization communal air chamber 61 and the negative pressurization communal air chamber 74. The positive negative pressurization communication valve 86 is provided in the middle of the positive negative pressurization communication pipe 87. The positive negative pressurization communication valve 86 is a normally-open solenoid valve.

The positive negative pressurization communication pipe forms the flow path of air through which the positive pressurization communal air chamber 61 and the negative pressurization communal air chamber 74 communicate with each other. One end of the positive negative pressurization communication pipe 87 is connected to the positive pressurization communal air chamber 61 and the other end is connected to the negative pressurization communal air chamber 74.

Note that, since the pressure generator 3 is shared by the printers 2 as described above, one pressure generator 3 including the aforementioned parts illustrated in FIG. 2 is provided for four printers 2.

The conveyor 4 picks up a sheet from a sheet feed tray (not illustrated) and conveys this sheet along a conveyance route. The conveyor 4 includes a roller for conveying the sheet, a motor for driving the roller (both parts are not illustrated), and the like.

The controller 5 controls operations of the parts in the inkjet printing apparatus 1. The controller 5 includes a CPU, a RAM, a ROM, a hard disk drive, and the like.

Next, pressure losses in a path from the sub-tank 41 to the ink circulation pump 28 and a path from the negative pressurization tank 24 to the ink circulation pump 28 are described.

Figure 3:
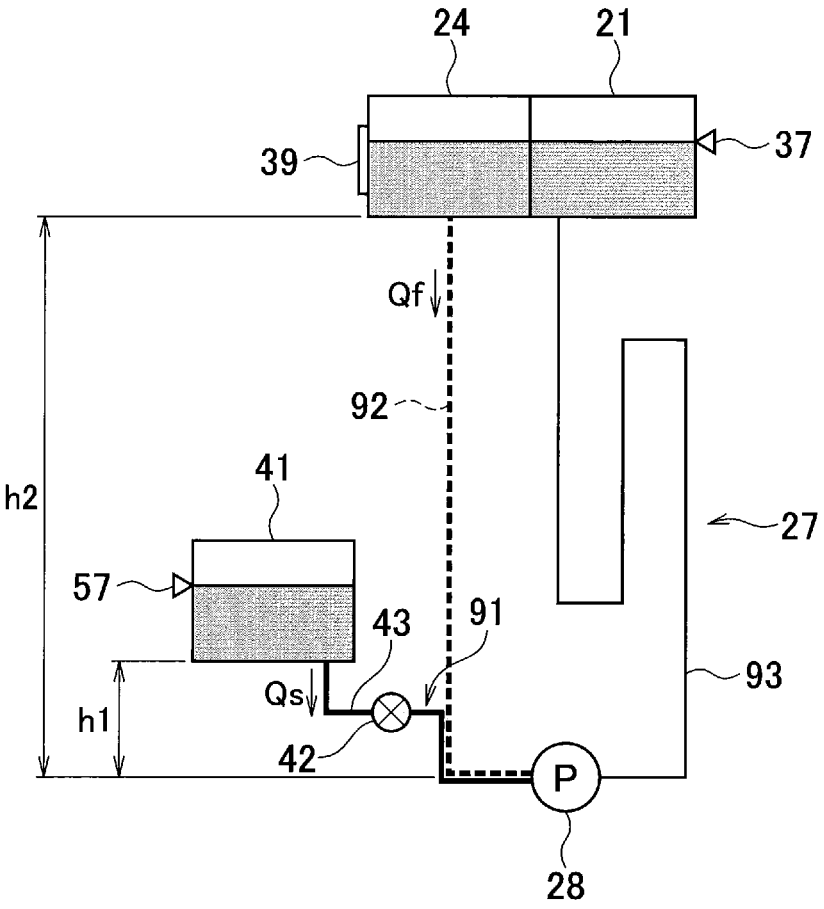
FIG. 3 is a simple model diagram for a pressure loss design in a path from a sub-tank to an ink circulation pump and a path from a negative pressurization tank to the ink circulation pump.

FIG. 3 is a simple model diagram for a pressure loss design in the path from the sub-tank 41 to the ink circulation pump 28 and the path from the negative pressurization tank 24 to the ink circulation pump 28. As illustrated in FIG. 3, the path from the sub-tank 41 to the ink circulation pump 28 is referred to as a sub-tank side path 91. Moreover, the path from the negative pressurization tank 24 to the ink circulation pump 28 is referred to as a negative pressurization tank side path 92. Furthermore, a path from the ink circulation pump 28 to the positive pressurization tank 21 is referred to as a positive pressurization tank side path 93.

The sub-tank side path 91 is a path of the ink formed of the connection pipe 43 and a portion of the ink circulation pipe 27 between the ink circulation pump 28 and a connection point with the connection pipe 43. The negative pressurization tank side path 92 is a path of the ink formed of a portion of the ink circulation pipe 27 between the negative pressurization tank 24 and the ink circulation pump 28. The positive pressurization tank side path 93 is a path of the ink formed of a portion of the ink circulation pipe 27 between the ink circulation pump 28 and the positive pressurization tank 21.

A flow amount Q in the case where viscous fluid flows through a circular tube with a radius of r and a length of 1 is expressed by the following formula (1) based on the Hagen-Poiseuille law.

$$Q=\pi\times r^4\times\Delta p/(8\times\mu\times 1) \quad (1)$$

In this formula, μ is the viscosity of the fluid and Δp is a difference between the pressure at an entrance of the circular tube and the pressure at an exit of the circular tube. When the flow path resistance $R=8\times\mu\times 1/(\pi\times r^4)$, the formula (1) is expressed by the following formula (2).

$$Q=\Delta p/R \quad (2)$$

When the formula (2) is applied to the simple model diagram of FIG. 3, the flow amount Qs in the sub-tank side path 91 and the flow amount Qf in the negative pressurization tank side path 92 can be expressed by the following formulae (3) and (4), respectively. In this case, the formula (2) is applied, assuming that the pressure at the position of the ink circulation pump 28 which corresponds to the exits of the sub-tank side path 91 and the negative pressurization tank side path 92 is zero.

$$Qs=(Ps+\rho\times g\times h1)/Rs \quad (3)$$

$$Qf=(Pfs+\rho\times g\times h2)/Rf \quad (4)$$

In these formulae, ρ is the density of the ink, g is the gravitational acceleration, h1 is the height difference (head difference) between an upper end of the sub-tank side path 91 and the ink circulation pump 28, h2 is the height difference (head difference) between an upper end of the negative pressurization tank side path 92 and the ink circulation pump 28, Rs is the flow path resistance of the sub-tank side path 91, and Rf is the flow path resistance of the negative pressurization tank side path 92.

Ps is the pressure in the sub-tank 41. As described later, in the embodiment, since the sub-tank 41 is in an atmospheric release state in the ink circulation, Ps is the atmospheric pressure. Pfs is the pressure in the negative pressurization tank 24 and is the set pressure in the negative pressurization tank 24 in the ink circulation.

In the inkjet printing apparatus 1, the flow path resistances Rs, Rf, the height differences h1, h2, and the set pressure Pfs of the negative pressurization tank 24 are set such that Qs>Qf. Specifically, the flow path resistances Rs, Rf, the height differences h1, h2, and the set pressure Pfs of the negative pressurization tank 24 are set such that the pressure loss in the sub-tank side path 91 is smaller than the pressure loss in the negative pressurization tank side path 92. In this case, the flow path resistances Rs, Rf are set by, for example, setting the lengths and the radiuses of the sub-tank side path 91 and the negative pressurization tank side path 92.

Next, air volume setting in the positive pressurization system and the negative pressurization system in the printers 2 and the pressure generator 3 is described.

As described above, the positive negative pressurization communication valve 86 is the normally-open solenoid valve. Moreover, the positive pressurization pressure adjustment valve 70 and the negative pressurization pressure adjustment valve 82 are the normally-closed solenoid valves. Accordingly, when emergency power supply shut down is performed during the ink circulation in a printing operation, the positive negative pressurization communication valve 86 is opened and the positive pressurization pressure adjustment valve 70 and the negative pressurization pressure adjustment valve 82 are closed. Moreover, when the positive pressurization air pump 66 and the negative pressurization air pump 79 are driven at the time of the emergency power supply shut down, the pumps 66, 79 are stopped.

Accordingly, when the emergency power supply shut down is performed during the ink circulation in the printing operation, a space in the positive pressurization system including the positive pressurization tanks 21 and the positive pressurization communal air chamber 61 and a space in the negative pressurization system including the negative pressurization tanks 24 and the negative pressurization communal air chamber 74 communicate with each other to forma space and the space formed by the communication is set to a sealed state.

In this case, the following formula (5) is satisfied based on the Boyle's law, where Pks is the set pressure in the positive pressurization tanks 21 in the ink circulation in the print operation, Pfs is the set pressure in the negative pressurization tanks 24 in the ink circulation, Vk is the air volume of the positive pressurization system, Vf is the air volume of the negative pressurization system, Px is the pressure in the aforementioned space formed by the communication. Note that, in this case, the printing is assumed to be performed by using all printers 2 with all positive pressurization sealing valves 62 and negative pressurization sealing pipes 76 opened.

$$Pks \times Vk + Pfs \times Vf = Px \times (Vk + Vf) \quad (5)$$

From the formula (5), the pressure Px in the space formed by the communication is expressed by the following formula (6).

$$Px = (Pks \times Vk + Pfs \times Vf)/(Vk + Vf) \quad (6)$$

In the inkjet printing apparatus 1, the air volume Vk of the positive pressurization system and the air volume Vf of the negative pressurization system are set such that the pressure Px in the aforementioned space formed by the communication becomes a negative pressure (slight negative pressure).

The air volume Vk of the positive pressurization system is an air volume of the space in the positive pressurization system including parts which communicate with the positive pressurization tanks 21 in the ink circulation and in which the pressure is set to the set pressure Pks together with the positive pressurization tanks 21. The air volume Vk of the positive pressurization system is expressed by the following formula (7).

$$Vk = 4 \times Vkt + Vkc + 4 \times Vkr + Vkp + Vkb + Vkn \quad (7)$$

In this formula, Vkt is the capacity of the air space 36 in each positive pressurization tank 21. Vkt corresponds to the volume of a space above the reference value of the liquid level height of the ink in the positive pressurization tank 21. Vkc is the capacity of the positive pressurization communal air chamber 61. Vkr is the total of the capacities of the positive pressurization sealing pipe 63, the positive pressurization air chamber 64, and the positive pressurization communication pipe 65 for each printer 2. Vkp is the capacity of a portion of the atmosphere communication pipe 68 between the positive pressurization communal air chamber 61 and the positive pressurization air pump 66. Vkb is the capacity of a portion of the positive pressurization pressure adjustment pipe 71 between the positive pressurization communal air chamber 61 and the positive pressurization pressure adjustment valve 70. Vkn is the capacity of a portion of the positive negative pressurization communication pipe 87 between the positive pressurization communal air chamber 61 and the positive negative pressurization communication valve 86.

The air volume Vf of the negative pressurization system is an air volume of the space in the negative pressurization system including parts which communicate with the negative pressurization tanks 24 in the ink circulation and in which the pressure is set to the set pressure Pfs together with the negative pressurization tanks 24. The air volume Vf of the negative pressurization system is expressed by the following formula (8).

$$Vf = 4 \times Vft + Vfc + 4 \times Vfr + Vfp + Vfb + Vfn \quad (8)$$

In this formula, Vft is the capacity of the air space 38 in each negative pressurization tank 24. Vft corresponds to the volume of a space above the reference value of the liquid level height of the ink in the negative pressurization tank 24. Vfc is the capacity of the negative pressurization communal air chamber 74. Vfr is the total of the capacities of the negative pressurization sealing pipe 76, the negative pressurization air chamber 77, and the negative pressurization communication pipe 78 for each printer 2. Vfp is the capacity of a portion of the negative pressurization pressure generation pipe 81 between the negative pressurization communal air chamber 74 and the negative pressurization air pump 79. Vfb is the capacity of a portion of the negative pressurization pressure adjustment pipe 83 between the negative pressurization communal air chamber 74 and the negative pressurization pressure adjustment valve 82. Vfn is the capacity of a portion of the positive negative pressurization communication pipe 87 between the negative pressurization communal air chamber 74 and the positive negative pressurization communication valve 86.

When the print operation is performed without using some of the printers 2, the positive pressurization sealing pipes 63 and the negative pressurization sealing pipes 76 for the not-used printers 2 are closed. In this case, when the emergency power supply shut down is performed during the ink circulation in the printing operation, the positive pressurization sealing valves 62 and the negative pressurization sealing valves 75 which are the normally-open solenoid valves are opened. The capacities of the parts in the positive pressurization system and the negative pressurization system are set such that the pressure in the space formed by the communication of the space in the positive pressurization system and the space in the negative pressurization system is a negative pressure also in this case.

Next, an operation of the inkjet printing apparatus 1 is described.

Figure 4:
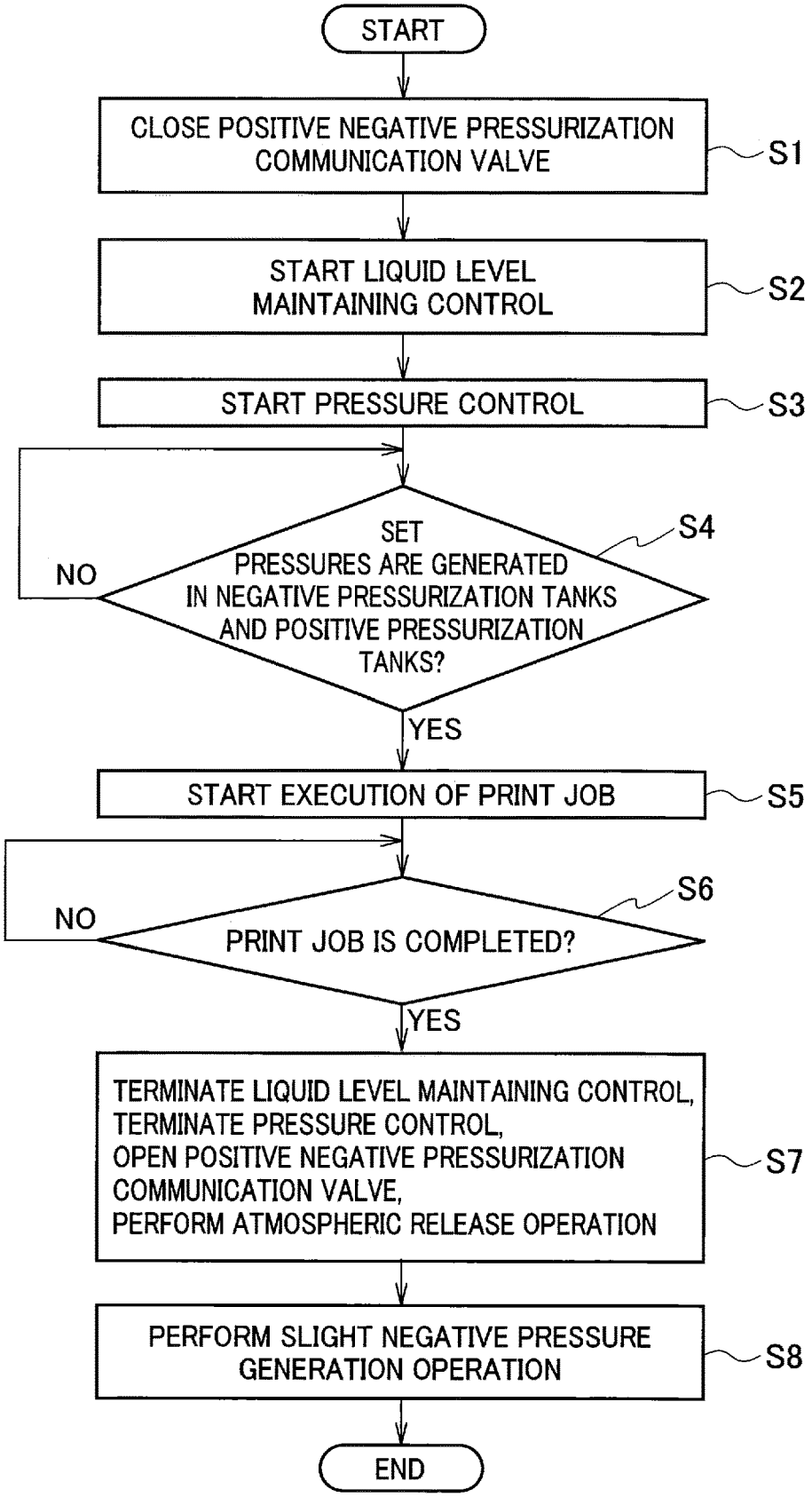
FIG. 4 is a flowchart for explaining an operation of the inkjet printing apparatus.

FIG. 4 is a flowchart for explaining the operation of the inkjet printing apparatus 1. Processing in the flowchart of FIG. 4 starts when the inkjet printing apparatus 1 receives a print job. In this description, the received print job is assumed to be a print job for performing printing by using all printers 2.

In step S1 of FIG. 4, the controller 5 closes the positive negative pressurization communication valve 86. Closing the positive negative pressurization communication valve 86 shuts off the communication between the positive pressurization communal air chamber 61 and the negative pressurization communal air chamber 74.

In a standby state in which no ink circulation or printing is performed, the positive negative pressurization communication valve 86 is open. Moreover, the sub-tank atmospheric release valves 44, the positive pressurization sealing valves 62, and the negative pressurization sealing valves 75 are also open. The ink supply valves 42, the sub-tank liquid level adjustment valves 50, the positive pressurization pump upstream valve 67, the positive pressurization pressure adjustment valve 70, the negative pressurization pump upstream valve 80, and the negative pressurization pressure adjustment valve 82 are closed.

Next, in step S2, the controller 5 starts liquid level maintaining control. The liquid level maintaining control is control for maintaining the liquid level in the positive pressurization tank 21, the negative pressurization tank 24, and the sub-tank 41 in each printer 2 at around the reference values thereof. In the liquid level maintaining control, the controller 5 controls the ink supply valve 42, the ink circulation pump 28, and the ink cartridge pump 48 depending on the liquid level heights in the positive pressurization tank 21, the negative pressurization tank 24, and the sub-tank 41.

Specifically, as illustrated in FIG. 5A, in a situation where the positive pressurization tank liquid level sensor 37 and the first negative pressurization tank threshold Hf1 and the second negative pressurization tank threshold Hf2 of the negative pressurization tank liquid level sensor 39 are all off, the controller 5 opens the ink supply valve 42 and turns off (stops) the ink circulation pump 28.

In a situation where the positive pressurization tank liquid level sensor 37 and the first negative pressurization tank threshold Hf1 of the negative pressurization tank liquid level sensor 39 are off and the second negative pressurization tank threshold Hf2 of the negative pressurization tank liquid level sensor 39 is on, the controller 5 opens the ink supply valve 42 and turns on (drives) the ink circulation pump 28.

In a situation where the positive pressurization tank liquid level sensor 37 is off and the first negative pressurization tank threshold Hf1 and the second negative pressurization tank threshold Hf2 of the negative pressurization tank liquid level sensor 39 are on, the controller 5 closes the ink supply valve 42 and turns on the ink circulation pump 28.

In a situation where the positive pressurization tank liquid level sensor 37 is on, the controller 5 closes the ink supply valve 42 and turns off the ink circulation pump 28 irrespective of the combination of on and off of the first negative pressurization tank threshold Hf1 and the second negative pressurization tank threshold Hf2 of the negative pressurization tank liquid level sensor 39.

Moreover, as illustrated in FIG. 5B, in a situation where the sub-tank liquid level sensor 57 is off, the controller 5 turns on the ink cartridge pump 48. In a situation where the sub-tank liquid level sensor 57 is on, the controller 5 turns off the ink cartridge pump 48.

Returning to FIG. 4, in step S3, the controller 5 starts pressure control. The pressure control is control for generating the set pressures Pks, Pfs in the positive pressurization tanks 21 and the negative pressurization tanks 24 and maintaining the generated set pressures Pks, Pfs. The set pressures Pks, Pfs are set as pressure values for setting a nozzle pressure in the inkjet head 11 to an appropriate value (negative pressure) while allowing the ink to be circulated in the ink circulator 12 at a predetermined ink circulation flow rate.

The controller 5 opens the positive pressurization pump upstream valve 67 and the negative pressurization pump upstream valve 80 before the start of the pressure control. In the pressure control, the controller 5 controls the positive pressurization air pump 66 and the positive pressurization pressure adjustment valve 70 depending on the pressure Pk in the positive pressurization tanks 21 detected by the positive pressurization pressure sensor 72. Moreover, the controller 5 controls the negative pressurization air pump 79 and the negative pressurization pressure adjustment valve 82 depending on the pressure Pf in the negative pressurization tanks 24 detected by the negative pressurization pressure sensor 84.

Specifically, as illustrated in FIG. 6A, in a situation where Pk<Pks, the controller 5 turns on the positive pressurization air pump 66 and closes the positive pressurization pressure adjustment valve 70. The positive pressurization air pump 66 thereby sends more air to the sealed positive pressurization tanks 21 and the pressure in the positive pressurization tanks 21 thus increases.

Moreover, in a situation where Pk Pks, the controller 5 turns off the positive pressurization air pump 66 and opens the positive pressurization pressure adjustment valve 70. Air thereby flows out from the positive pressurization tanks 21 through the positive pressurization pressure adjustment pipe 71 and the pressure in the positive pressurization tanks 21 thus decreases.

Moreover, as illustrated in FIG. 6B, in a situation where |Pf|<|Pfs|, the controller 5 turns on the negative pressurization air pump 79 and closes the negative pressurization pressure adjustment valve 82. The negative pressurization air pump 79 thereby sucks air from the sealed negative pressurization tanks 24 and the pressure in the negative pressurization tanks 24 thus decreases (the absolute value of the negative pressure increases).

Moreover, in a situation where |Pf|≥|Pfs|, the controller 5 turns off the negative pressurization air pump 79 and opens the negative pressurization pressure adjustment valve 82. Air thereby flows into the negative pressurization tanks 24 via the negative pressurization pressure adjustment pipe 83 and the pressure in the negative pressurization tanks 24 thus increases (the absolute value of the negative pressure decreases).

Note that the pressure control may be started before the start of the liquid level maintaining control.

Returning to FIG. 4, in step S4, the controller 5 determines whether the set pressures Pks, Pfs are generated in the positive pressurization tanks 21 and the negative pressurization tanks 24. When the controller 5 determines that the set pressure is not generated in at least one of the positive pressurization tanks 21 and the negative pressurization tanks 24 (step S4: NO), the controller 5 repeats step S4.

When the controller 5 determines that the set pressures Pks, Pfs are generated in the positive pressurization tanks 21 and the negative pressurization tanks 24 (step S4: YES), in step S5, the controller 5 starts execution of the print job. Specifically, the controller 5 prints an image based on the print job by ejecting the inks from the inkjet heads 11 to the sheet conveyed by the conveyor 4.

During the execution of the print job, in each printer 2, the ink is supplied from the positive pressurization tank 21 to the inkjet head 11 and the ink not consumed in the inkjet head 11 is collected in the negative pressurization tank 24. When the situation comes where the positive pressurization tank liquid level sensor 37 is off and the first negative pressurization tank threshold Hf1 and the second negative pressurization tank threshold Hf2 of the negative pressurization tank liquid level sensor 39 are on, the ink circulation pump 28 is made to deliver the ink from the negative pressurization tank 24 to the positive pressurization tank 21 by the liquid level maintaining control. The printing is thereby performed with the ink circulated.

When the ink amount in the ink circulator 12 decrease due to consumption of the ink and the situation comes where the positive pressurization tank liquid level sensor 37 and the first negative pressurization tank threshold Hf1 of the negative pressurization tank liquid level sensor 39 are off and the second negative pressurization tank threshold Hf2 is on, the ink supply valve 42 is opened and the ink circulation pump 28 is driven by the liquid level maintaining control.

Figure 7:
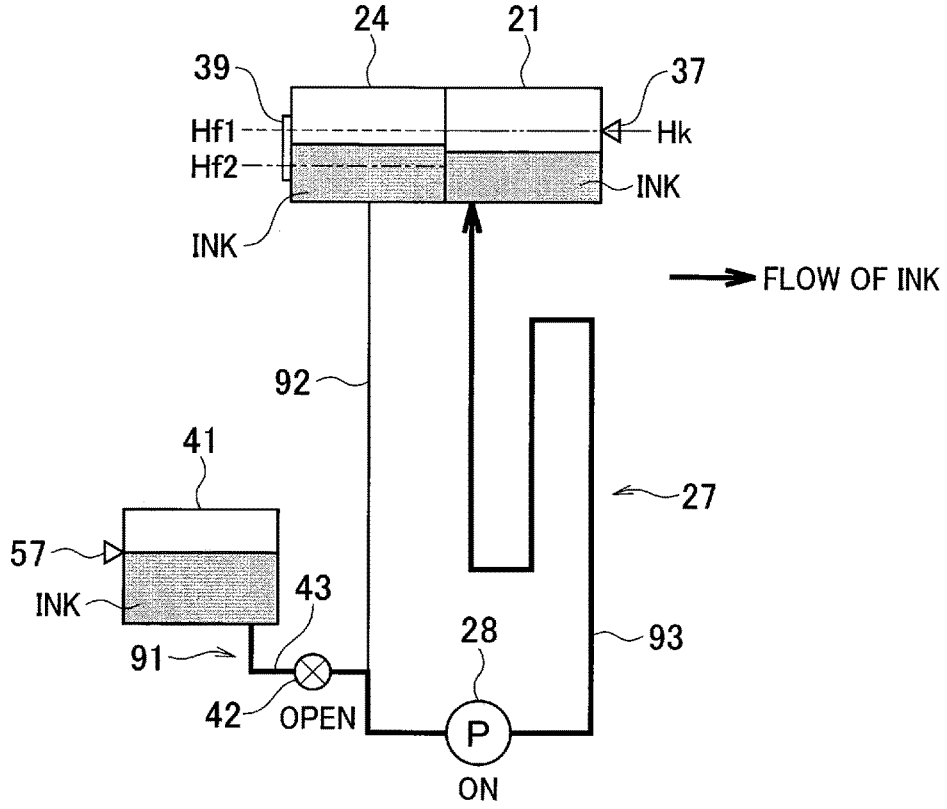
FIG. 7 is an explanatory diagram of ink supply from the sub-tank to a positive pressurization tank.

As illustrated in FIG. 7, the ink is thereby supplied from the sub-tank 41 to the positive pressurization tank 21 via the sub-tank side path 91 and the positive pressurization tank side path 93. As a result, the ink is supplied to the ink circulator 12. The ink flows as illustrated in FIG. 7 when the ink supply valve 42 is open and the ink circulation pump 28 is driven because the pressure loss in the sub-tank side path 91 is smaller than the pressure loss in the negative pressurization tank side path 92 as described above.

When the situation comes where the positive pressurization tank liquid level sensor 37 and the first negative pressurization tank threshold Hf1 and the second negative pressurization tank threshold Hf2 of the negative pressurization tank liquid level sensor 39 are all off, the ink supply valve 42 is opened with the ink circulation pump 28 stopped by the liquid level maintaining control.

Figure 8:
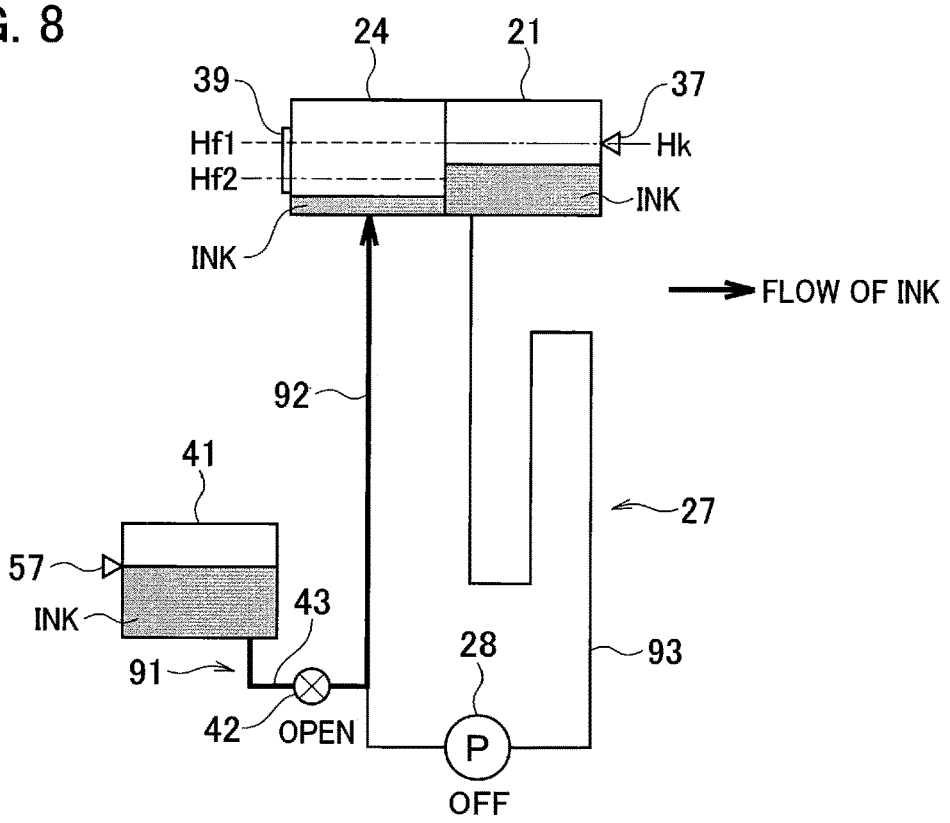
FIG. 8 is an explanatory diagram of ink supply from the sub-tank to the negative pressurization tank.

This causes the ink to be drawn from the sub-tank 41 into the negative pressurization tank 24 as illustrated in FIG. 8 due to the pressure difference between the negative pressurization tank 24 to which the negative pressure is applied and the sub-tank 41 in the atmospheric release state. In this case, the ink is delivered from the sub-tank 41 to the negative pressurization tank 24 via the connection pipe 43 which is part of the sub-tank side path 91 and a portion of the ink circulation pipe 27 between the negative pressurization tank 24 and the connection point with the connection pipe 43 which is part of the negative pressurization tank side path 92. As a result, the ink is supplied to the ink circulator 12.

When the ink is supplied from the sub-tank 41 to the positive pressurization tank 21 by opening the ink supply valve 42 and driving the ink circulation pump 28 as illustrated in FIG. 7, a small amount of ink flows out from the negative pressurization tank 24. Accordingly, when the ink in the negative pressurization tank 24 is few, there is a risk that the negative pressurization tank 24 is empty of the ink and air is sucked from the negative pressurization tank 24 into the ink circulation pipe 27, thereby causing mixing of air into the ink circulation pipe 27.

Accordingly, when the positive pressurization tank liquid level sensor 37 is off and the second negative pressurization tank threshold Hf2 of the negative pressurization tank liquid level sensor 39 is also off, the ink supply valve 42 is opened with the ink circulation pump 28 stopped and the ink is supplied to the negative pressurization tank 24 as illustrated in FIG. 8.

When the sub-tank liquid level sensor 57 turns off due to the supplying of the ink from the sub-tank 41 to the negative pressurization tank 24, the ink cartridge pump 48 is made to replenish the sub-tank 41 with the ink from the ink cartridge 47 by the liquid level maintaining control.

Returning to FIG. 4, in step S6, the controller 5 determines whether the print job is completed. When the controller 5 determines that the print job is not completed (step S6: NO), the controller 5 repeats step S6.

When the controller 5 determines that the print job is completed (step S6: YES), in step S7, the controller 5 terminates the liquid level maintaining control and the pressure control, opens the positive negative pressurization communication valve 86, and executes an atmospheric release operation. The atmospheric release operation is an operation of opening the positive pressurization pressure adjustment valve 70 and the negative pressurization pressure adjustment valve 82 to make the positive pressurization tanks 21 and the negative pressurization tanks 24 open to the atmosphere.

When the ink circulation pump 28 is driven at the termination of the liquid level maintaining control, the controller 5 stops the ink circulation pump 28. Moreover, when the ink supply valve 42 is open, the controller 5 closes the ink supply valve 42. Furthermore, when the ink cartridge pump 48 is driven, the controller 5 stops the ink cartridge pump 48.

Moreover, when the positive pressurization air pump 66 is driven at the termination of the pressure control, the controller 5 stops the positive pressurization air pump 66. The same applies to the negative pressurization air pump 79. Furthermore, the controller 5 closes the positive pressurization pump upstream valve 67 and the negative pressurization pump upstream valve 80.

Moreover, when the positive pressurization pressure adjustment valve 70 is closed at the termination of the pressure control, the controller 5 opens the positive pressurization pressure adjustment valve 70. When the positive pressurization pressure adjustment valve 70 is open, the controller 5 maintains the open state. This also applies to the negative pressurization pressure adjustment valve 82. Setting the positive pressurization pressure adjustment valve 70 and the negative pressurization pressure adjustment valve 82 to the open state at the termination of the pressure control due to the completion of the print job corresponds to the atmospheric release operation.

Figure 9:
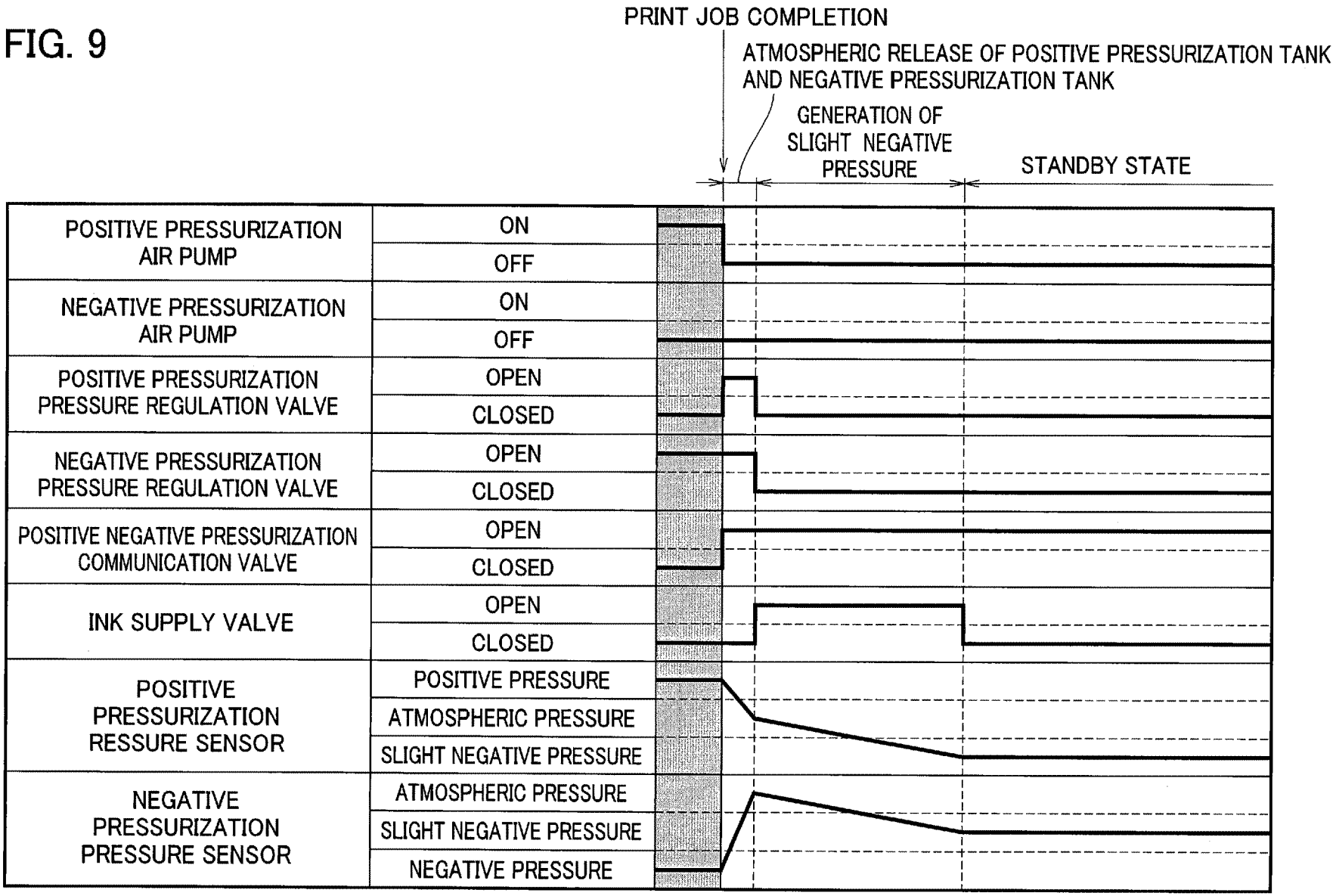
FIG. 9 is a timing chart of an atmospheric release operation and a slight negative pressure generation operation.

Setting the positive pressurization pressure adjustment valve 70 and the negative pressurization pressure adjustment valve 82 to the open state with the termination of the pressure control due to the completion of the print job causes the pressure Pk in the positive pressurization tanks 21 detected by the positive pressurization pressure sensor 72 to change from the positive pressure (set pressure Pks) to the atmospheric pressure and causes the pressure Pf in the negative pressurization tanks 24 detected by the negative pressurization pressure sensor 84 to change from the negative pressure (set pressure Pfs) to the atmospheric pressure as illustrated in FIG. 9. As a result, the positive pressurization tanks 21 and the negative pressurization tanks 24 are set to the atmospheric release state.

Returning to FIG. 4, in step S8, the controller 5 executes a slight negative pressure generation operation. Specifically, when the positive pressurization tanks 21 and the negative pressurization tanks 24 are set to the atmospheric release state, the controller 5 closes the positive pressurization pressure adjustment valve 70 and the negative pressurization pressure adjustment valve 82 and opens the ink supply valves 42 as illustrated in FIG. 9.

The positive pressurization tanks 21 and the negative pressurization tanks 24 are thereby set to the sealed state and the sub-tanks 41 in the atmospheric release state and the ink circulation pipes 27 are made to communicate with each other. A negative pressure is thereby generated in the positive pressurization tanks 21 and the negative pressurization tanks 24 due to the head difference between the sub-tanks 41 and the sets of the positive pressurization tanks 21 and the negative pressurization tanks 24. When the pressure Pk in the positive pressurization tanks 21 detected by the positive pressurization pressure sensor 72 and the pressure Pf in the negative pressurization tanks 24 detected by the negative pressurization pressure sensor 84 become a predetermined value which is the slight negative pressure, the controller 5 closes the ink supply valves 42.

The series of operations is thereby completed and the inkjet printing apparatus 1 is set to the standby state. In the standby state, since the pressure in the positive pressurization tanks 21 and the negative pressurization tanks 24 is the slight negative pressure, the nozzle pressure in the inkjet heads 11 is the slight negative pressure and ink leakage from the nozzles can be suppressed.

When the emergency power supply shut down is performed during the ink circulation in the printing operation, the operation of the inkjet printing apparatus 1 stops without the aforementioned atmospheric release operation and slight negative pressure generation operation performed. In this case, as described above, the positive negative pressurization communication valve 86 opens. This causes the space in the positive pressurization system and the space in the negative pressurization system to communicate with other to form a space and the space formed by communication is set to the sealed state.

In this regard, as described above, the air volume Vk of the positive pressurization system and the air volume Vf of the negative pressurization system are set such that the pressure Px in the space formed by the communication becomes the negative pressure (slight negative pressure). Accordingly, even when the operation of the inkjet printing apparatus 1 stops due to the emergency power supply shut down, the nozzle pressure in the inkjet heads 11 becomes the slight negative pressure and the ink leakage from the nozzles can be suppressed.

As described above, in the inkjet printing apparatus 1, the ink is supplied to the ink circulator 12 by delivering the ink from the sub-tank 41 to the positive pressurization tank 21, the ink delivered by driving the ink circulation pump 28 with the ink supply valve 42 open.

Supplying the ink to the ink circulator 12 by driving the ink circulation pump 28 as described above is advantageous to a method in which the ink is supplied to the ink circulator 12 by using the negative pressure to draw the ink from the sub-tank 41 into the negative pressurization tank 24 in the following points. The ink can be supplied at a high supply rate also when the inkjet printing apparatus 1 is large and the ink circulation pipe 27 is long and thus has a large flow path resistance. Moreover, the ink can be supplied at a sufficient supply rate also when the inkjet printing apparatus 1 has high productivity and consumes a large amount of ink. Accordingly, occurrence of insufficient ink supply to the ink circulator 12 can be suppressed.

It is possible to increase the ink supply rate and suppress occurrence of insufficient ink supply also in the method in which the ink is supplied to the ink circulator 12 by using the negative pressure to draw the ink into the negative pressurization tank 24, by increasing the negative pressure generated in the negative pressurization tank 24. However, when the negative pressure in the negative pressurization tank 24 is increased, a pump with a larger capacity needs to be used as the ink circulation pump 28 for the ink circulation. This leads to an increase in the apparatus size. Meanwhile, in the inkjet printing apparatus 1, the ink is supplied by driving the ink circulation pump 28 and this can suppress an increase in the apparatus size which may otherwise occur when the pump with a large capacity is used as the ink circulation pump 28 as described above.

Moreover, using the ink circulation pump 28 for the ink supply eliminates the need for providing a pump dedicated to the ink supply and the increase in the apparatus size can be thus suppressed.

Accordingly, in the inkjet printing apparatus 1, it is possible to suppress the occurrence of insufficient ink supply to the ink circulator 12 while suppressing the increase in the apparatus size.

Moreover, in the inkjet printing apparatus 1, the pressure loss in the sub-tank side path 91 is smaller than the pressure loss in the negative pressurization tank side path 92. This causes the ink to be delivered not from the negative pressurization tank 24 but from sub-tank 41 to the positive pressurization tank 21 when the ink supply valve 42 is opened and the ink circulation pump 28 is driven. Accordingly, delivery of the ink from the sub-tank 41 to the positive pressurization tank 21 by the ink circulation pump 28 can be performed without a mechanism such a valve which prevents flow of the ink from the negative pressurization tank 24 to the ink circulation pump 28 provided. Accordingly, the ink supply from the sub-tank 41 to the positive pressurization tank 21 by the ink circulation pump 28 can be performed without a new element added to the apparatus.

Moreover, in the inkjet printing apparatus 1, when the liquid level height in the negative pressurization tank 24 is lower than the second negative pressurization tank threshold Hf2 in an event of performing the ink supply to the ink circulator 12, the ink supply to the ink circulator 12 is performed such that the ink supply valve 42 is opened with the ink circulation pump 28 stopped to cause the negative pressure to draw the ink from the sub-tank 41 into the negative pressurization tank 24. This can prevent the case where the negative pressurization tank 24 is empty of the ink and air is mixed into the ink circulation pipe 27.

Moreover, in the inkjet printing apparatus 1, the ink supply valve 42 is closed in the standby state. This suppresses the movement of the ink from the positive pressurization tank 21 and the negative pressurization tank 24 to the sub-tank 41 when air leakage occurs in a sealed space including the air space 36 in the positive pressurization tank 21 and the air space 38 in the negative pressurization tank 24 in the standby state. Accordingly, it is possible to reduce a risk of overflowing in the sub-tank 41. Moreover, since the risk of overflowing can be reduced, the size of the sub-tank 41 can be reduced.

Note that, in the aforementioned embodiment, description is given of the configuration in which the pressure loss in the sub-tank side path 91 is set lower than that in the negative pressurization tank side path 92 to cause the ink to be delivered from the sub-tank 41 to the positive pressurization tank 21 when the ink circulation pump 28 is driven with the ink supply valve 42 open. However, the configuration may be such that a mechanism such as a valve which prevents the ink from flowing from the negative pressurization tank 24 to the ink circulation pump 28 is provided on the ink circulation pipe 27 and the ink is delivered from the sub-tank 41 to the positive pressurization tank 21 by driving the ink circulation pump 28.

Moreover, although the configuration in which the inkjet printing apparatus 1 includes four printers 2 used for printing on one side is described in the aforementioned embodiment, the number of the printers 2 is not limited to four. For example, the configuration may be such that the inkjet printing apparatus 1 includes total of eight printers 2 including four printers 2 which perform printing on one side of the sheet and four printers which perform printing on the other side of the sheet. When there are eight printers 2, the air volume Vk of the positive pressurization system is expressed by a formula in which "4" in "4×Vkt" and "4×Vkr" in the formula (7) is replaced by "8." Moreover, the air volume Vf of the negative pressurization system is expressed by a formula in which "4" in "4×Vft" and "4×Vfr" in the formula (8) is replaced by "8."

The embodiment of the disclosure has, for example, the following configurations.

An inkjet printing apparatus includes: an inkjet head; an ink circulator including a first tank configured to supply ink to the inkjet head, a second tank configured to collect the ink from the inkjet head, an inter-tank path through which the ink is delivered from the second tank to the first tank, and an ink deliverer arranged in the inter-tank path and configured to deliver the ink from the second tank to the first tank through the inter-tank path; a third tank; a connection path connecting the third tank and the inter-tank path to each other; and a switch arranged in the connection path and configured to switch whether to allow or shut off communication between the inter-tank path and the third tank. Ink supply to the ink circulator is performed by driving the ink deliverer to deliver the ink from the third tank to the first tank with the communication between the inter-tank path and the third tank allowed by the switch.

A pressure loss in a path from the third tank to the ink deliverer may be smaller than a pressure loss in a path from the second tank to the ink deliverer.

Upon a liquid level height in the second tank being lower than a threshold in performing the ink supply to the ink circulator, the ink supply to the ink circulator may be performed by allowing the second tank to draw the ink from the third tank into the second tank by a negative pressure with the ink deliverer stopped and with the communication between the inter-tank path and the third tank allowed by the switch.

The switch may shut off the communication between the inter-tank path and the third tank in a standby state where ink circulation by the ink circulator is not performed.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printing apparatus comprising:

an inkjet head;

an ink circulator including a first tank configured to supply ink to the inkjet head, a second tank configured to collect the ink from the inkjet head, an inter-tank path through which the ink is delivered from the second tank to the first tank, and an ink deliverer arranged in the inter-tank path and configured to deliver the ink from the second tank to the first tank through the inter-tank path;

a third tank;

a connection path connecting the third tank and the inter-tank path to each other; and a switch arranged in the connection path and configured to switch whether to allow or shut off communication between the inter-tank path and the third tank, wherein an ink supply of the ink to the ink circulator is performed by driving the ink deliverer to deliver the ink from the third tank to the first tank with the communication between the inter-tank path and the third tank allowed by the switch.

2. The inkjet printing apparatus according to claim 1, further comprising a path from the third tank to the ink deliverer and a path from the second tank to the ink deliverer, wherein a pressure loss of the ink that flows in the path from the third tank to the ink deliverer is smaller than a pressure loss of the ink that flows in the path from the second tank to the ink deliverer.

3. The inkjet printing apparatus according to claim 1, wherein upon a liquid level height in the second tank being lower than a threshold in performing the ink supply to the ink circulator, the ink supply to the ink circulator is performed by allowing the second tank to draw the ink from the third tank into the second tank by a negative pressure with the ink deliverer stopped and with the communication between the inter-tank path and the third tank allowed by the switch.

4. The inkjet printing apparatus according to claim 1, wherein the switch shuts off the communication between the inter-tank path and the third tank in a standby state where ink circulation by the ink circulator is not performed.

* * * * *